US008506071B2

(12) United States Patent
Sato

(10) Patent No.: US 8,506,071 B2
(45) Date of Patent: Aug. 13, 2013

(54) RECORDING APPARATUS

(75) Inventor: Makoto Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 151 days.

(21) Appl. No.: 13/081,626

(22) Filed: Apr. 7, 2011

(65) Prior Publication Data

US 2011/0254894 A1 Oct. 20, 2011

(30) Foreign Application Priority Data

Apr. 16, 2010 (JP) ..... 2010-095025

(51) Int. Cl.
*B41J 2/01* (2006.01)

(52) U.S. Cl.
USPC ..... 347/104; 347/29; 347/32; 347/33

(58) Field of Classification Search
USPC ..... 347/29, 32, 33, 104
See application file for complete search history.

(56) References Cited

U.S. PATENT DOCUMENTS

| | | | | |
|---|---|---|---|---|
| 6,899,421 | B2 | 5/2005 | Taguchi et al. | |
| 7,673,985 | B2 | 3/2010 | Sasa | |
| 7,722,182 | B2 | 5/2010 | Sasa | |
| 2002/0135653 | A1* | 9/2002 | Otsuki | 347/104 |
| 2004/0027412 | A1* | 2/2004 | Takahashi et al. | 347/34 |
| 2005/0093951 | A1* | 5/2005 | Takatsuka et al. | 347/101 |
| 2005/0162452 | A1* | 7/2005 | Kachi | 347/13 |
| 2007/0030303 | A1* | 2/2007 | Ha et al. | 347/33 |
| 2007/0040864 | A1* | 2/2007 | Jung et al. | 347/22 |
| 2008/0186374 | A1* | 8/2008 | Ito et al. | 347/104 |
| 2009/0002448 | A1* | 1/2009 | Hosono et al. | 347/47 |
| 2009/0244170 | A1 | 10/2009 | Mikashima | |
| 2010/0201739 | A1* | 8/2010 | Yamaguchi | 347/32 |
| 2011/0157288 | A1* | 6/2011 | Morimoto et al. | 347/104 |
| 2011/0242220 | A1* | 10/2011 | Yamagishi et al. | 347/47 |

FOREIGN PATENT DOCUMENTS

| | | | |
|---|---|---|---|
| CN | 1907721 | | 2/2007 |
| CN | 101544120 | | 9/2009 |
| CN | 101670709 | | 3/2010 |
| JP | 2001219548 | A * | 8/2001 |
| JP | 2004-106432 | | 4/2004 |
| JP | 2007283624 | A * | 11/2007 |

OTHER PUBLICATIONS

Machine translation of JP 2001-219548 A. (JP 2001-219548 A was published Aug. 14, 2001.).*
Machine translation of JP 2007-283624 A. (JP 2007-283624 A was published Nov. 1, 2007.).*

* cited by examiner

*Primary Examiner* — Matthew Luu
*Assistant Examiner* — Justin Seo
(74) *Attorney, Agent, or Firm* — Workman Nydegger

(57) ABSTRACT

A recording apparatus that can prevent a medium from dropping into an opening provided in a supporting member for supporting the other side of the medium, on one side of which recording is performed, without changing the shape of the opening is provided. A printer includes a recording head that performs recording on one side of a sheet P being transported in a transportation direction X; a platen having a fixed rib that is fixed and supports the other side of the sheet P, and an opening provided in a region facing the recording head; and a movable rib that moves in the opening in a width direction intersecting the transportation direction between a supporting position where it supports the other side of the sheet P and a position at a distance from the supporting position.

10 Claims, 11 Drawing Sheets

RECORDING APPARATUS

The entire disclosure of Japanese Patent Application No. 2010-095025, filed Apr. 16, 2010 is expressly incorporated by reference herein.

BACKGROUND

1. Technical Field

The present invention relates to recording apparatuses.

2. Related Art

Conventionally, ink jet printers, serving as recording apparatuses, that perform printing (recording) by ejecting fluid, such as ink, onto one side of a sheet (medium) from a recording head are widely known. Such a printer typically includes a platen for supporting the other side of a sheet, on one side of which recording is performed (for example, see JP-A-2004-106432).

Furthermore, such a printer sometimes has an opening in the platen, in which an ink absorbing member is provided for receiving ejected ink landed outside an edge of a sheet or for receiving ink ejected during flushing performed between printing operations. The provision of such an opening sometimes has caused a paper jam because the leading end of a sheet dropped into the opening is caught by the opening.

Accordingly, in the printer disclosed in JP-A-2004-106432, for example, at least three openings having a smaller opening area than the conventional opening are arranged in a staggered manner, so that a sheet is prevented from dropping into the opening.

However, because the shape of the openings has to be designed according to the shape of the recording head, sometimes it has been difficult to change the shape of the openings into a shape that effectively prevents dropping of a sheet.

SUMMARY

An advantage of some aspects of the invention is that it provides a recording apparatus that can prevent a medium from dropping into an opening provided in a supporting member for supporting the other side of the medium, on one side of which recording is performed, without changing the shape of the opening.

A recording apparatus according to an aspect of the invention includes a recording head that performs recording on one side of a medium being transported in a transportation direction; a supporting member having a fixed supporting portion that is fixed and supports the other side of the medium, and an opening provided in a region facing the recording head; and a movable supporting portion that moves in the opening in a width direction intersecting the transportation direction between a supporting position where it supports the other side of the medium and a position at a distance from the supporting position.

In this configuration, although the supporting member has the opening, the movable supporting portion that moves in the transportation direction intersecting the width direction is provided in the opening. Thus, when the medium is transported, the movable supporting portion moves to the supporting position so that it can support the other side of the medium, in cooperation with the fixed supporting portion. Accordingly, it is possible to prevent the medium from dropping into the opening provided in the supporting member for supporting the other side of the medium, on one side of which recording is performed, without changing the shape of the opening.

In the recording apparatus, the movable supporting portion may have a length corresponding to the opening in the transportation direction.

In this configuration, because the movable supporting portion has a length corresponding to the opening in the transportation direction, the movable supporting portion can support the medium regardless of the shape of the opening.

In the recording apparatus, the fixed supporting portion may include a plurality of fixed ribs that are arranged side-by-side in the width direction and extend in the transportation direction, and the movable supporting portion may include a movable rib having a shape corresponding to the fixed ribs.

In this configuration, the movable supporting portion can use the position where the fixed ribs are provided in the width direction as a supporting position, and the region where the fixed ribs are not provided in the width direction as a retracting position. Because the movable supporting portion is the movable rib having a shape corresponding to the fixed ribs, by moving the movable supporting portion to the supporting position at the side of the fixed ribs in the transportation direction, the movable supporting portion can also support the medium like the fixed ribs.

In the recording apparatus, the recording head may perform recording by ejecting fluid onto the medium, a receptacle for receiving the fluid ejected from the recording head may be disposed in the opening, and, when the recording head ejects fluid onto one side of the receptacle in the width direction, the movable supporting portion may be retracted to the other side in the width direction.

In this configuration, the receptacle for receiving ink ejected from the recording head is disposed in the opening. Because the movable supporting portion can move in the width direction, when the recording head ejects fluid onto one side of the receptacle in the width direction, the movable supporting portion can be retracted to the other side in the width direction. By allowing the recording head to eject fluid separately to one side and the other side of the receptacle in the width direction, the movable supporting portion does not have to be completely retracted from the position where the receptacle is provided. Thus, the time required for the movable supporting portion to be retracted from the supporting position can be reduced. Therefore, even when the medium is transported at high speed, flushing, in which fluid is ejected toward the receptacle, can be performed between transportation operations for transporting the medium.

The recording apparatus may further include a cap that can move between a contact position where it is in contact with the recording head through the opening and a separated position at a distance from the recording head. The movable supporting portion may be retracted to a position at the side of the cap in the width direction, when the cap moves to the contact position.

In this configuration, the cap is disposed in the opening. Because the movable supporting portion can move in the width direction, the movable supporting portion can be retracted to the position at the side of the cap in the width direction, when the cap is lifted and moved to the contact position where it is in contact with the recording head.

The recording apparatus may further include a wiping member that moves in the width direction to wipe the recording head. The movable supporting portion may be formed of the wiping member.

In this configuration, because the movable supporting portion is formed of the wiping member that wipes the recording head, no special component for forming the movable supporting portion is needed.

The recording apparatus may further include a wiping member that moves in the width direction to wipe the recording head; and a moving mechanism that moves the wiping member and the movable supporting portion in the width direction.

In this configuration, the moving mechanism that moves the wiping member and the movable supporting portion in the width direction is provided. Thus, the movable supporting portion and the wiping member share the moving mechanism, whereby an increase in the number of components can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Referring to FIGS. 1 to 10, embodiments in which the invention is embodied as an ink jet printer (hereinafter simply referred to as a "printer"), which is one type of the recording apparatus, will be described below. Note that the terms "front-rear direction", "left-right direction", and "top-bottom direction" used in the following description respectively mean the front-rear direction, the left-right direction, and the top-bottom direction indicated by arrows in the figures.

Figure 1:
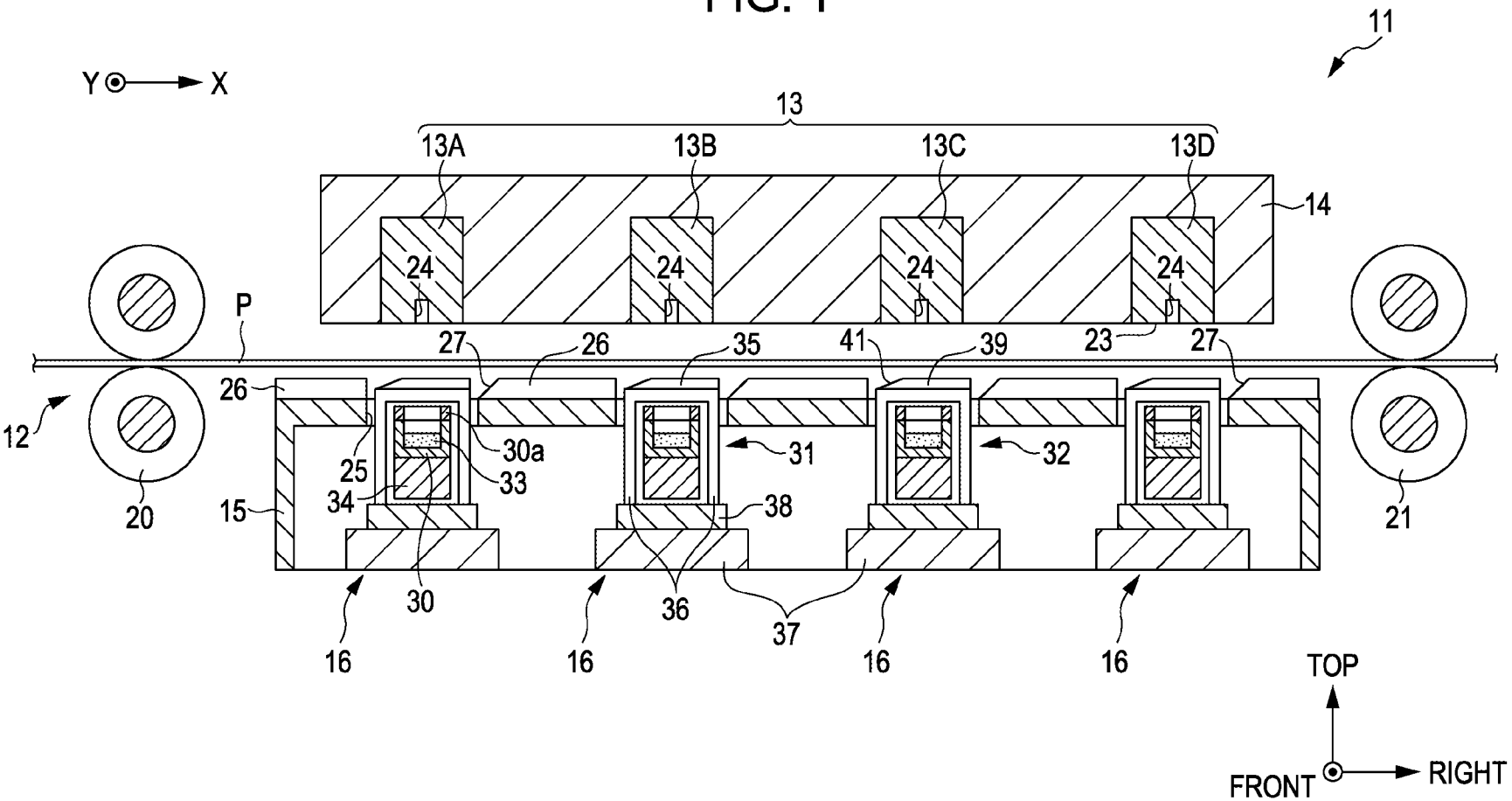
FIG. 1 is a cross-sectional view showing the schematic configuration of a recording apparatus according to this embodiment.

As shown in FIG. 1, a printer 11 serving as a recording apparatus includes a transporting unit 12 that transports a sheet P, serving as a medium, in the transportation direction X (toward the right direction in FIG. 1), a head unit 14 having a plurality of (four in this embodiment) recording heads 13, a platen 15 serving as a supporting member, and maintenance units 16 accommodated in the platen 15.

The transporting unit 12 includes a sheet-feed roller pair 20, a sheet-discharge roller pair 21, and a transportation motor (not shown) for rotating the sheet-feed roller pair 20 and the sheet-discharge roller pair 21. By being rotationally driven by the transportation motor, the sheet-feed roller pair 20 holds the sheet P therebetween and feeds the sheet P onto the platen 15, and the sheet-discharge roller pair 21 discharges the sheet P from the platen 15.

Figure 2:
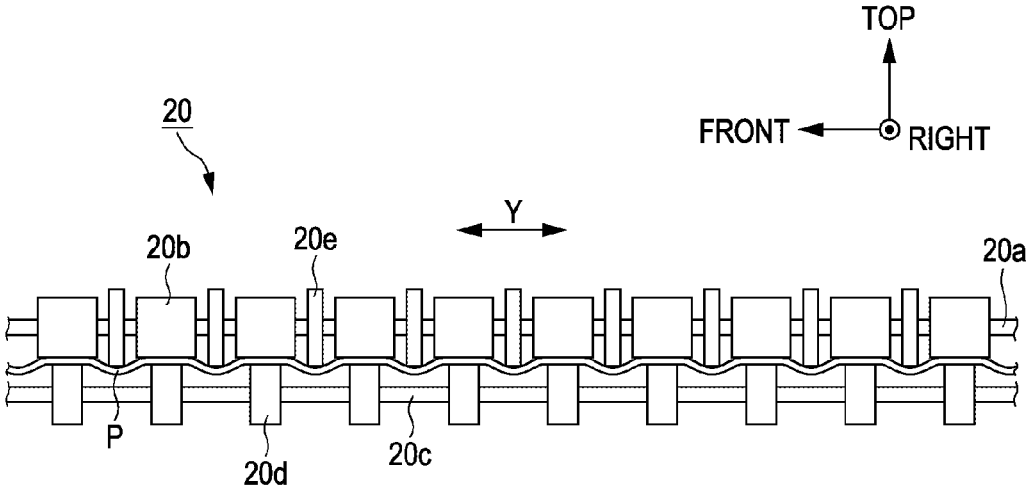
FIG. 2 is a side view showing the configuration of a transporting roller pair.

As shown in FIG. 2, the sheet-feed roller pair 20 includes a driving shaft 20*a* connected to the transportation motor, driving rollers 20*b* supported by the driving shaft 20*a*, a rotation shaft 20*c*, driven rollers 20*d* supported by the rotation shaft 20*c*, and corrugation rollers 20*e*. The rotation shaft 20*c* is urged against the driving shaft 20*a* by an urging member (not shown).

Thus, the sheet-feed roller pair 20 holds the sheet P between the driving rollers 20*b* and the driven rollers 20*d*.

The corrugation rollers 20*e* having a larger diameter than the driving rollers 20*b* are supported by the driving shaft 20*a* and are arranged next to the driving rollers 20*b*. Note that the corrugation rollers 20*e* may be supported by the rotation shaft 20*c*.

The corrugation rollers 20*e* cause the sheet P held between the sheet-feed roller pair 20 to have a slightly wavy shape in the width direction Y so as to increase the rigidity of the sheet P. More specifically, recording is performed on one side (top surface side) of the sheet P on the platen 15. At this time, if the sheet P is bent in the transportation direction X, the recording position is shifted, deteriorating the recording quality. Thus, by feeding the sheet P having increased rigidity, the sheet P is prevented from bending.

As shown in FIG. 1, the recording heads 13 (13A, 13B, 13C, and 13D) corresponding to different colors of ink (fluid) are arranged side-by-side in the transportation direction X in the head unit 14. Furthermore, nozzle forming surfaces 23 formed of the lower surfaces of the recording heads 13 have a plurality of nozzles 24 through which ink is ejected.

Figure 3:
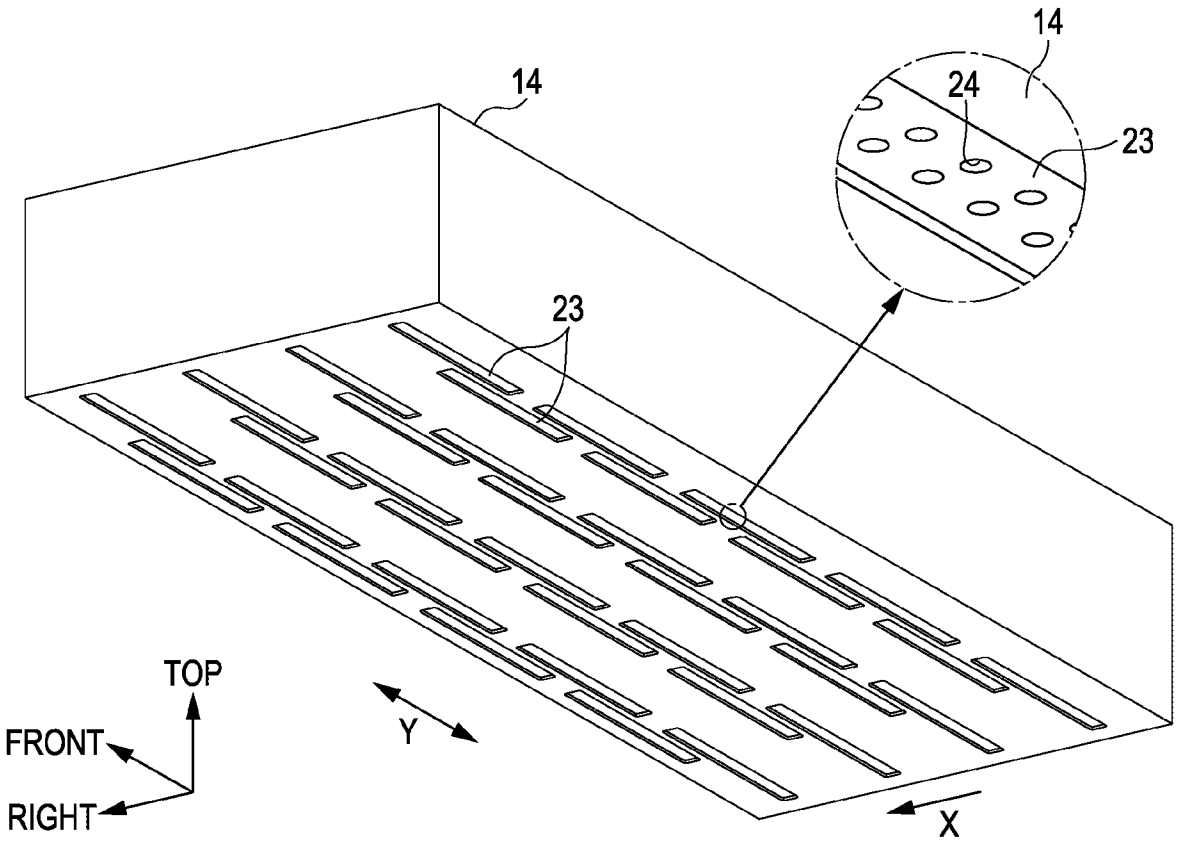
FIG. 3 is a perspective view of a head unit as viewed from obliquely below.

As shown in FIG. 3, the nozzle forming surfaces 23 of the recording heads 13, which are arranged in a staggered manner in the transportation direction X and the width direction Y (front-rear direction) intersecting the transportation direction X, are exposed in the lower surface of the head unit 14. Furthermore, the nozzles 24 in the nozzle forming surfaces 23 are arranged at equal intervals in the width direction Y.

That is, the head unit 14 has a plurality of recording heads 13 arranged in the width direction Y, thereby forming a line head capable of performing printing over the maximum sheet width in a fixed state without needing to have a long recording head. By sequentially ejecting different colors of ink from the nozzles 24 in the recording heads 13 without stopping the sheet P transported by the sheet-feed roller pair 20 and the sheet-discharge roller pair 21 on the platen 15, recording (printing) is performed on the sheet P.

Figure 4:
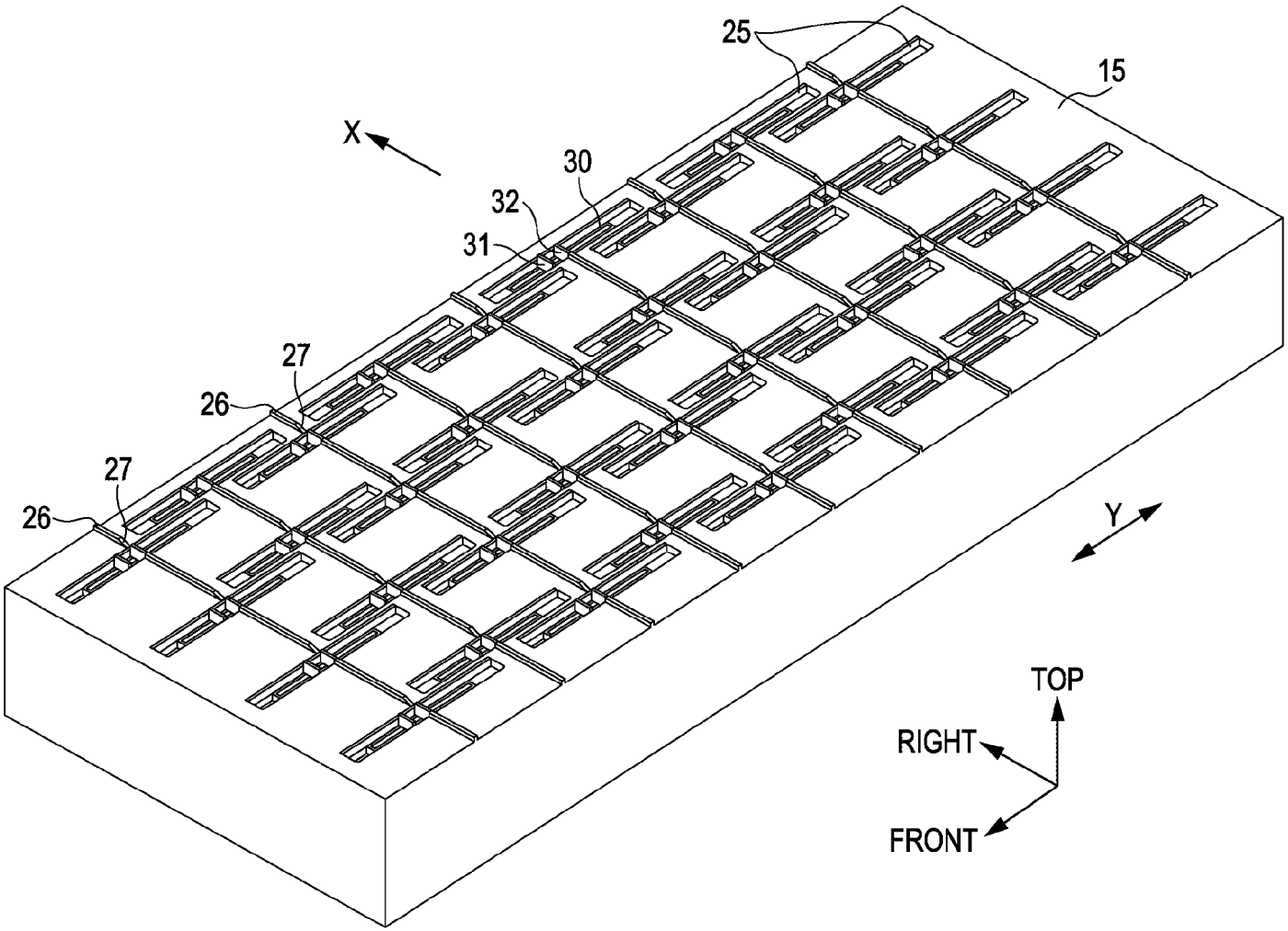
FIG. 4 is a perspective view of a platen accommodating maintenance units.
Figure 5:
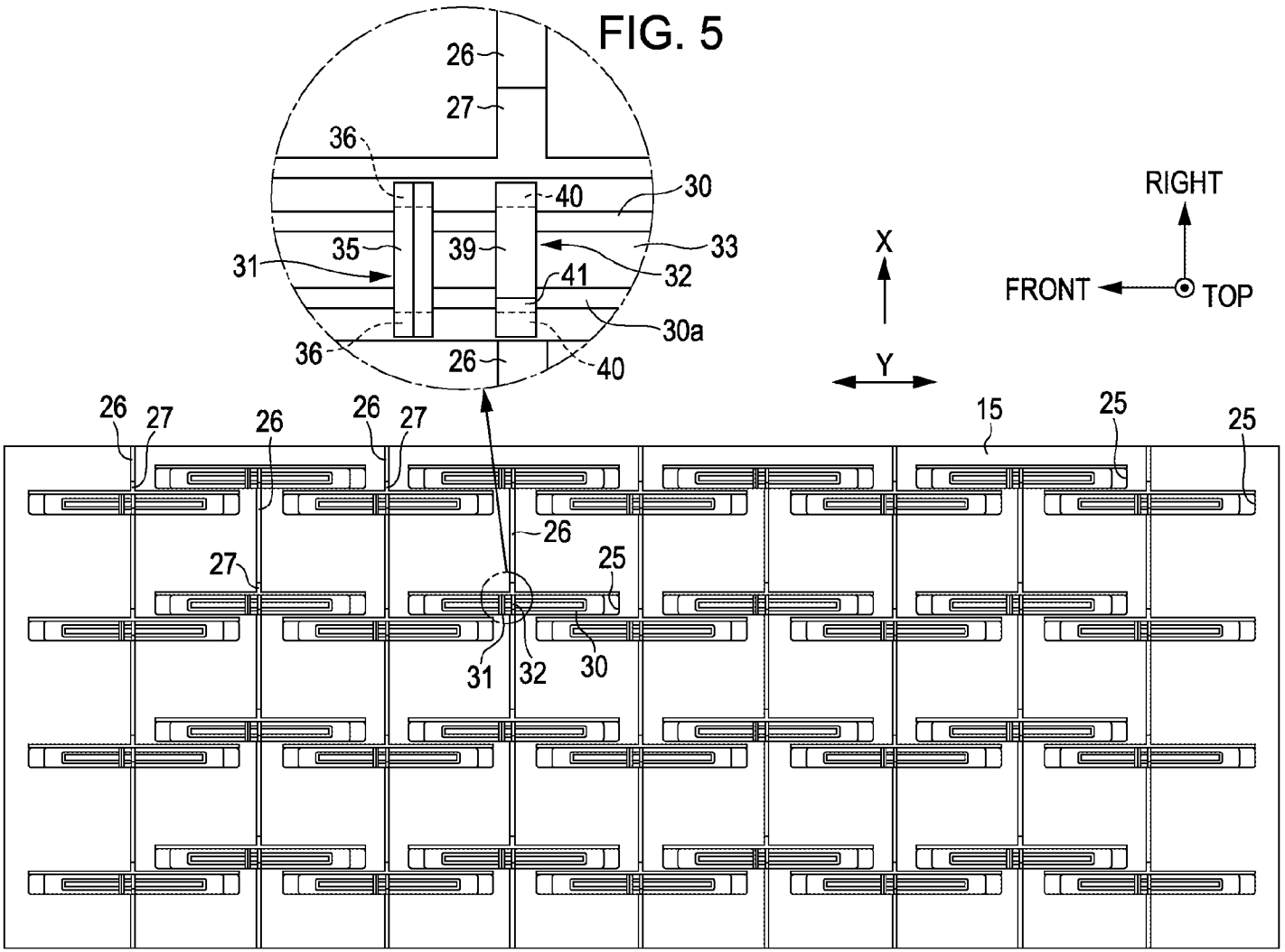
FIG. 5 is a top view of the platen accommodating the maintenance units.

As shown in FIGS. 4 and 5, the top surface of the platen 15 has openings 25 in regions facing the nozzle forming surfaces 23 of the recording heads 13. Furthermore, the top surface of the platen 15 has fixed ribs 26, serving as fixed supporting portions, which are fixed and support the lower surface (the other side) of the sheet P whose rigidity is increased by the sheet-feed roller pair 20.

As shown in FIGS. 1, 4, and 5, the plurality of fixed ribs 26 extend in the transportation direction X and are arranged side-by-side in the width direction Y, at positions corresponding to the corrugation rollers 20*e* of the sheet-feed roller pair 20. Furthermore, slanted surfaces 27 are provided at the left ends of the top surfaces of the fixed ribs 26, corresponding to the upstream side in the transportation direction X, so as not to interfere with the sheet P.

As shown in FIGS. 1 and 5, the maintenance units 16 each include a cap 30 that has the shape of a box with a bottom and is disposed in the opening 25, and a wiping member 31. Furthermore, movable ribs 32 serving as movable supporting portions, having a shape corresponding to the fixed ribs 26, are provided on the rear side of the wiping members 31.

Note that the openings 25 and the caps 30 are elongated in the width direction Y in plan view, in accordance with the shape of the recording heads 13. Furthermore, the wiping members 31 and the movable ribs 32 are elongated in the transportation direction X.

As shown in FIG. 1, each cap 30 includes a rectangular frame-like sealing portion 30*a* formed of an elastic member at the upper end. Furthermore, each cap 30 accommodates an ink absorbing member 33 at the inner bottom portion, which serves as a receptacle for receiving ink ejected from the recording heads 13. The caps 30 are moved in the top-bottom direction by a lifting mechanism 34, so as to move between the contact position where the sealing portions 30*a* are in contact with the nozzle forming surfaces 23 of the recording heads 13 and the separated position where the sealing portions 30*a* are separated from the recording heads 13.

As shown in FIGS. 1 and 5, each wiping member 31 includes a sliding contact portion 35 that extends in the transportation direction X (left-right direction) so as to straddle the sealing portion 30*a* of the cap 30 and supporting post portions 36 that support the left and right ends of the sliding contact portion 35. The wiping members 31 are moved in the width direction Y by the moving mechanism 37 (see FIG. 1) while the sliding contact portions 35 are in contact with the nozzle forming surfaces 23 of the recording heads 13, thereby wiping the nozzle forming surfaces 23. Furthermore, the wiping members 31 are moved in the top-bottom direction by a lifting mechanism 38 (see FIG. 1), so as to move between the contact position where the wiping members 31 are in contact with the nozzle forming surfaces 23 of the recording heads 13 and the separated position where the wiping members 31 are separated from the recording heads 13.

Each movable rib 32 includes a supporting portion 39 that extends in the transportation direction X (left-right direction) so as to straddle the sealing portion 30*a* of the cap 30 and supports the sheet P and supporting post portions 40 that support the left and right ends of the supporting portion 39. The supporting portions 39 have a length corresponding to the openings 25 in the transportation direction X and a length corresponding to the fixed ribs 26 in the width direction Y. Furthermore, slanted surfaces 41 are provided at the left ends of the top surfaces of the movable ribs 32, corresponding to the upstream side in the transportation direction X, so as not to interfere with the sheet P.

Figure 6:
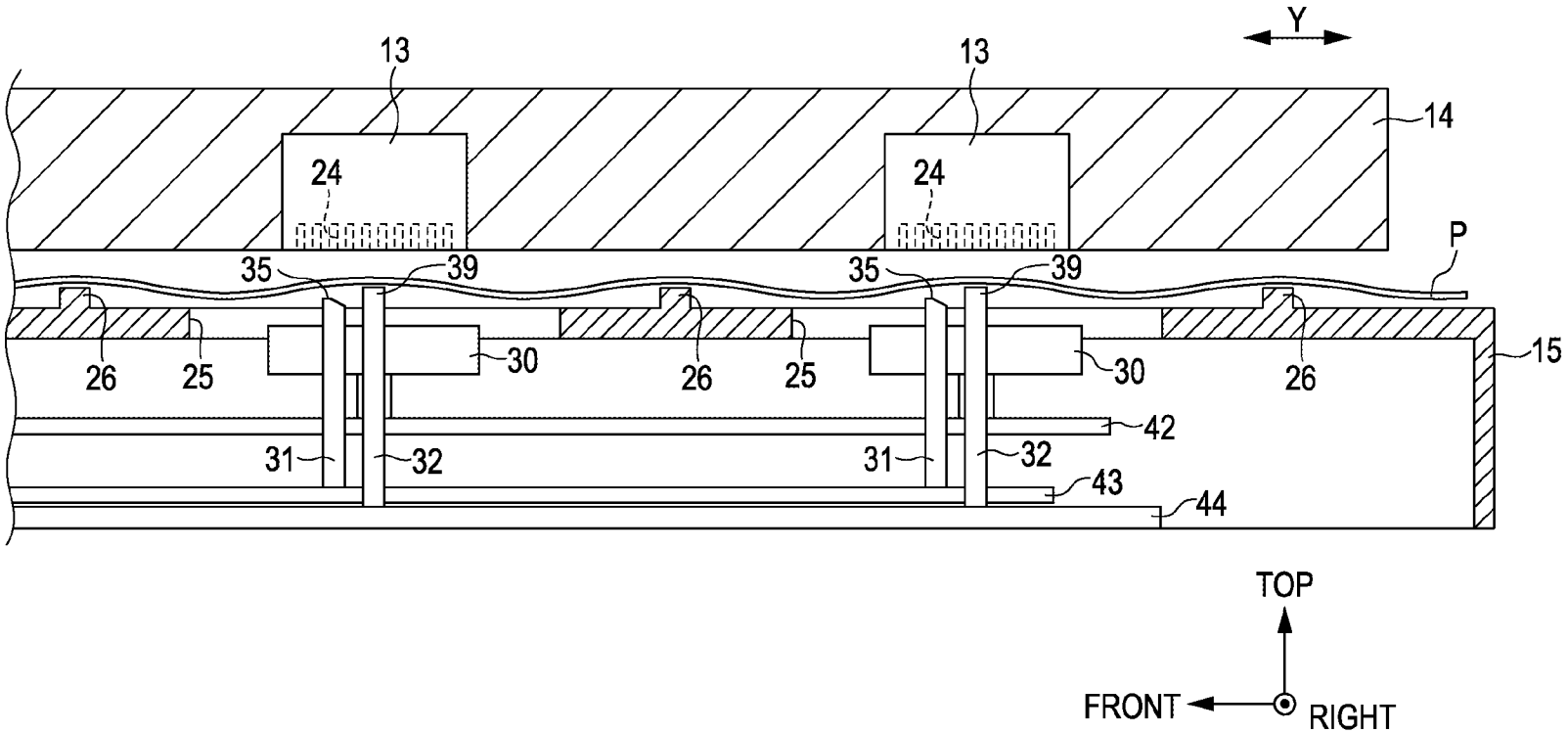
FIG. 6 is a cross-sectional view showing the position of movable ribs when printing is performed.

As shown in FIG. 6, the plurality of caps 30 arranged side-by-side in the width direction Y are supported by base portions 42 constituting the lifting mechanism 34. Furthermore, the plurality of wiping members 31 arranged side-by-side in the width direction Y are supported by base portion 43 constituting the lifting mechanism 38. Thus, the caps 30 and the wiping members 31 arranged side-by-side in the width direction Y are supported so as to be capable of vertically moving by the common lifting mechanisms 34 and 38, respectively.

For simplicity's sake, FIGS. 6 to 11 show the recording heads 13 in a smaller scale (such that the recording heads 13 have a smaller length in the width direction Y).

Furthermore, the base portion 43 of the lifting mechanism 38 and the plurality of movable ribs 32 arranged in the width direction Y are supported by the base portion 44 constituting the moving mechanism 37. Thus, the plurality of wiping members 31 and the movable ribs 32 arranged in the width direction Y are enabled to move in the width direction Y by the common moving mechanism 37. Note that the lifting mechanisms 34 and 38 and the moving mechanism 37 have driving sources and transmission mechanisms (for example, cam mechanisms and rack and pinion mechanisms) (not shown) for moving the base portions 42, 43, and 44, respectively.

Next, an operation of the printer 11 will be described.

First, when printing is performed on a sheet P, the movable ribs 32 are moved to the supporting position at the side of the fixed ribs 26 in the width direction Y, as shown in FIGS. 4 and 5. Thus, as shown in FIG. 6, the other side of the sheet P transported in the transportation direction X is supported by the supporting portions 39 of the movable ribs 32 and the fixed ribs 26.

When printing is continuously performed on a plurality of sheets P, the printer 11 performs flushing, in which ink is ejected toward the ink absorbing members 33 in the caps 30, between printing operations to prevent clogging of the nozzles 24. This flushing is performed alternately on the front half (one side) and on the rear half (the other side) of the nozzles 24 arranged in the width direction Y.

Figure 7:
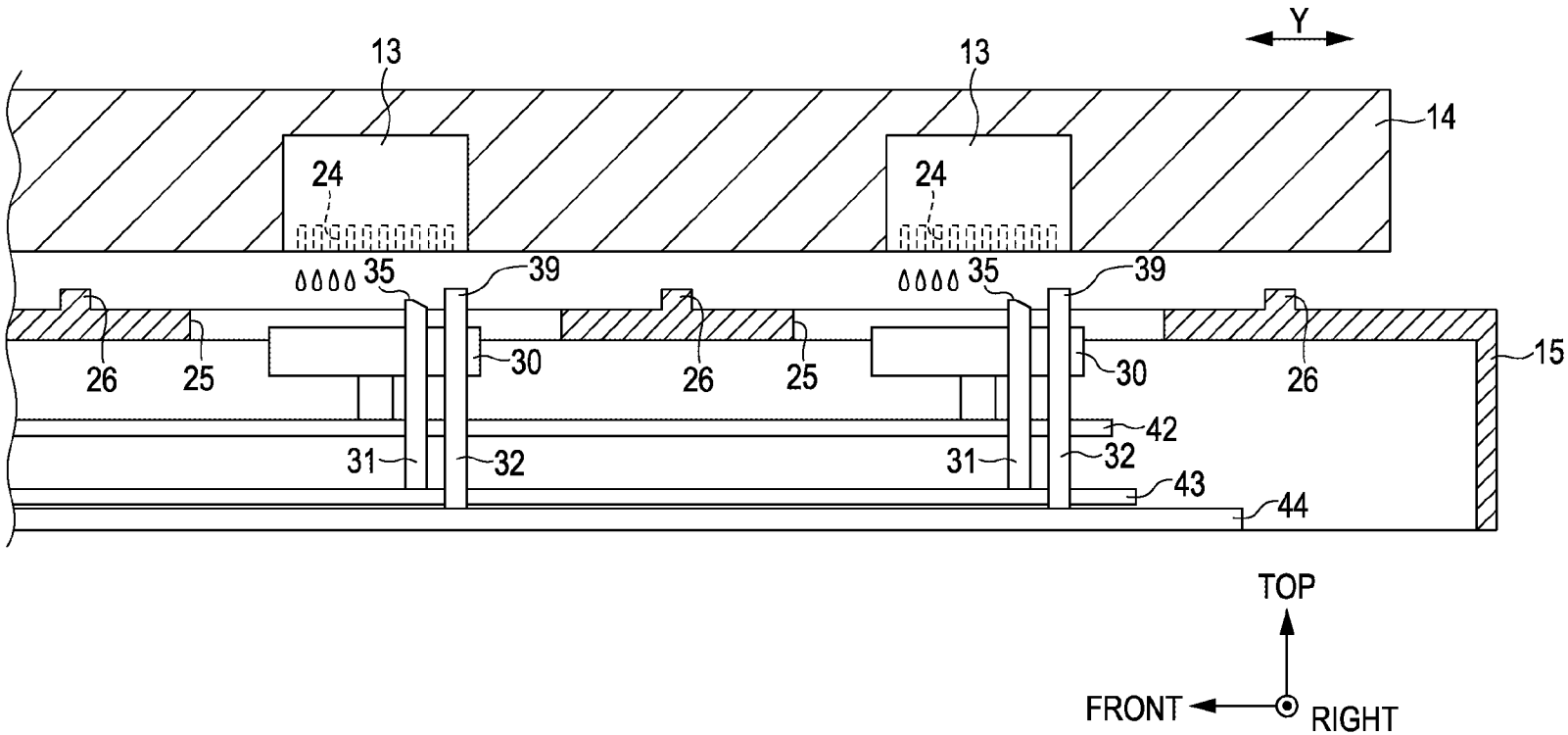
FIG. 7 is a cross-sectional view showing the position of the movable ribs when flushing is performed toward the front side of caps.
Figure 8:
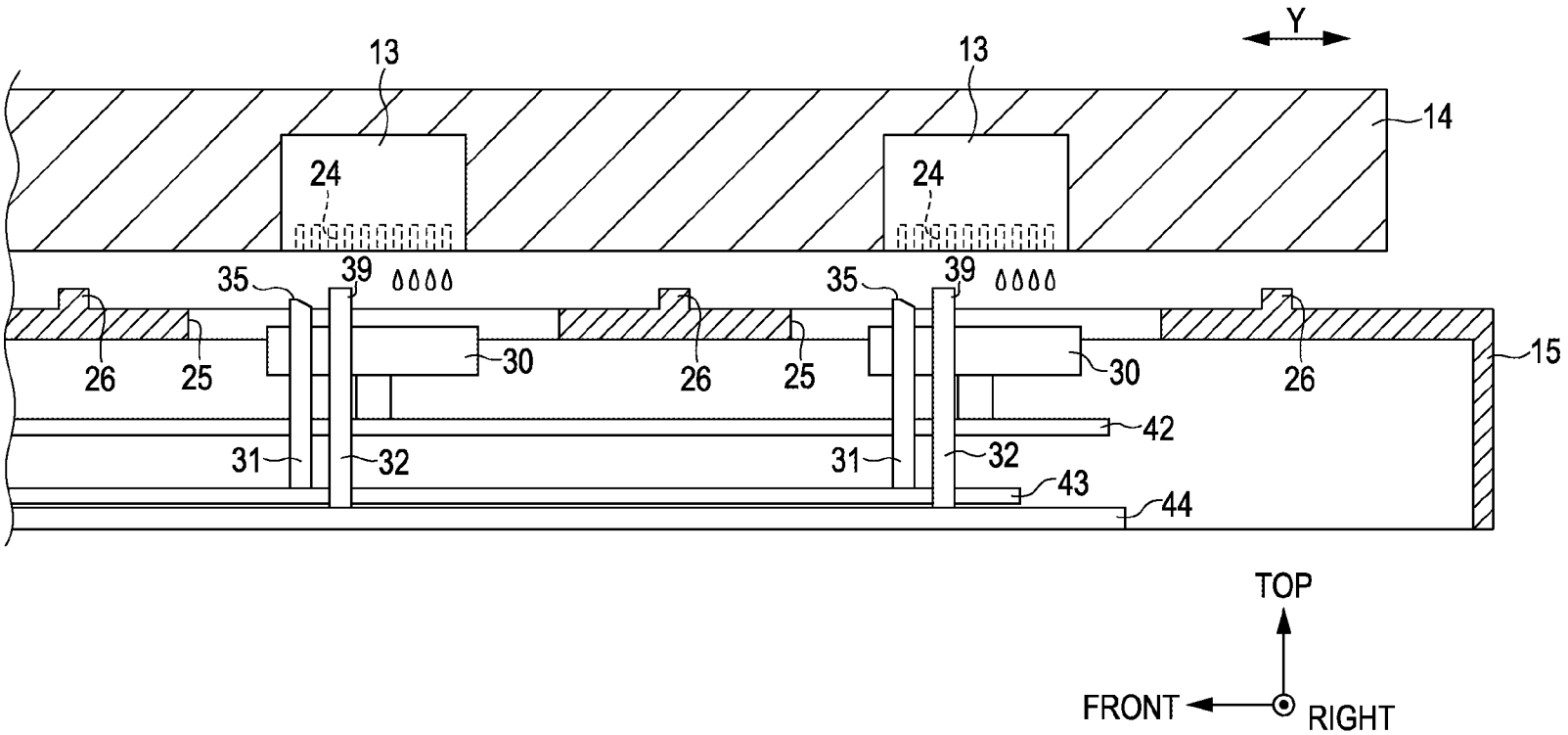
FIG. 8 is a cross-sectional view showing the position of the movable rib when flushing is performed toward the rear side of the cap.

When ink is ejected from the nozzles 24 on the front side of the recording heads 13 in the width direction Y to the front side of the ink absorbing member 33, as shown in FIG. 7, the movable ribs 32 are retracted to the rear side. In contrast, when ink is ejected from the nozzles 24 on the rear side of the recording heads 13 in the width direction Y toward the rear side of the ink absorbing member 33, as shown in FIG. 8, the movable ribs 32 are retracted to the front side.

Figure 9:
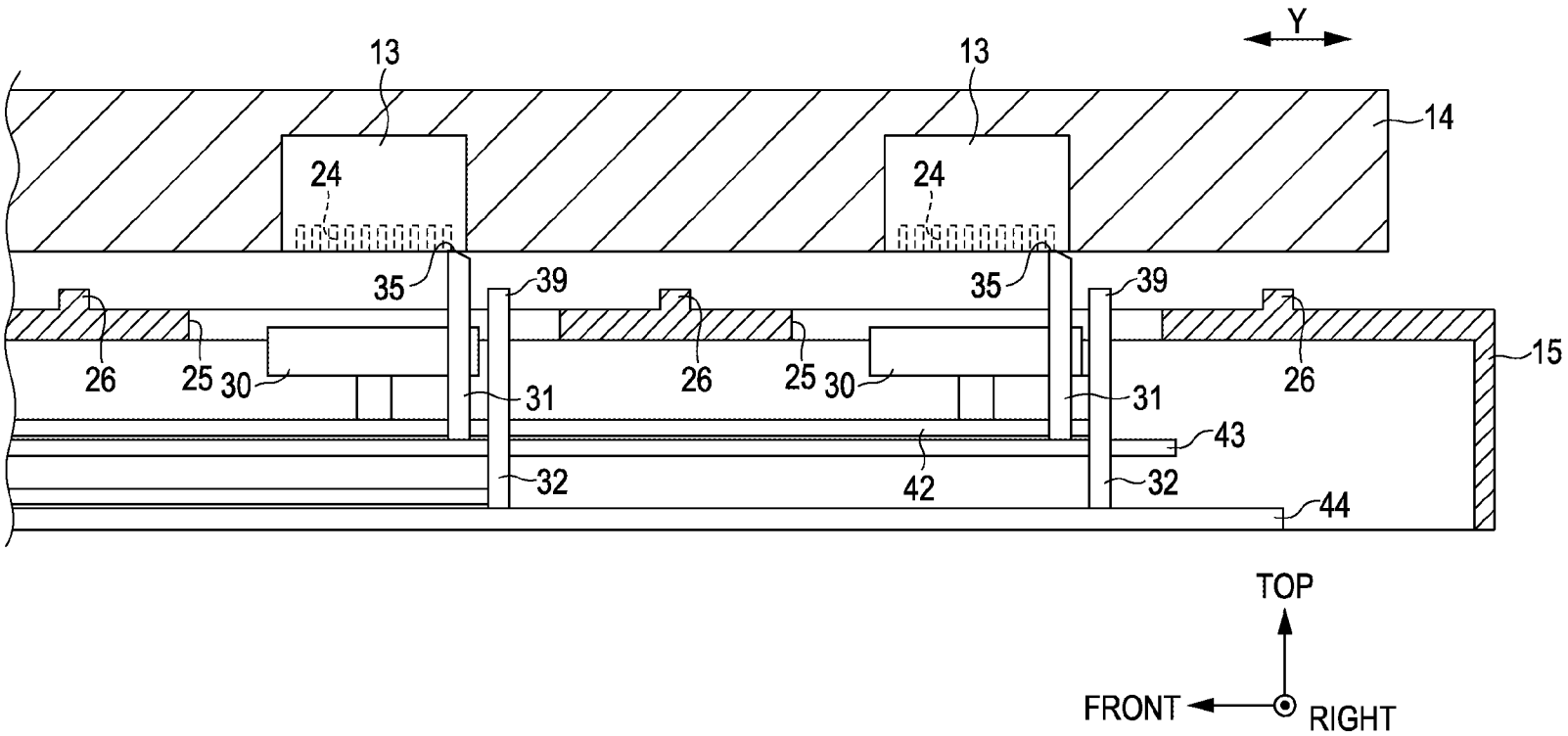
FIG. 9 is a cross-sectional view showing the position of wiping members when wiping is performed.

Furthermore, in the printer 11, wiping, in which wiping members 31 wipe the nozzle forming surfaces 23 of the recording heads 13 with the sliding contact portions 35 while moving in the width direction Y, is performed, for example, every time one printing job is completed, as shown in FIG. 9. At this time, the wiping members 31 are lifted by the lifting mechanism 38 to the position where they are in contact with the nozzle forming surfaces 23 and are moved forward by the moving mechanism 37.

Figure 10:
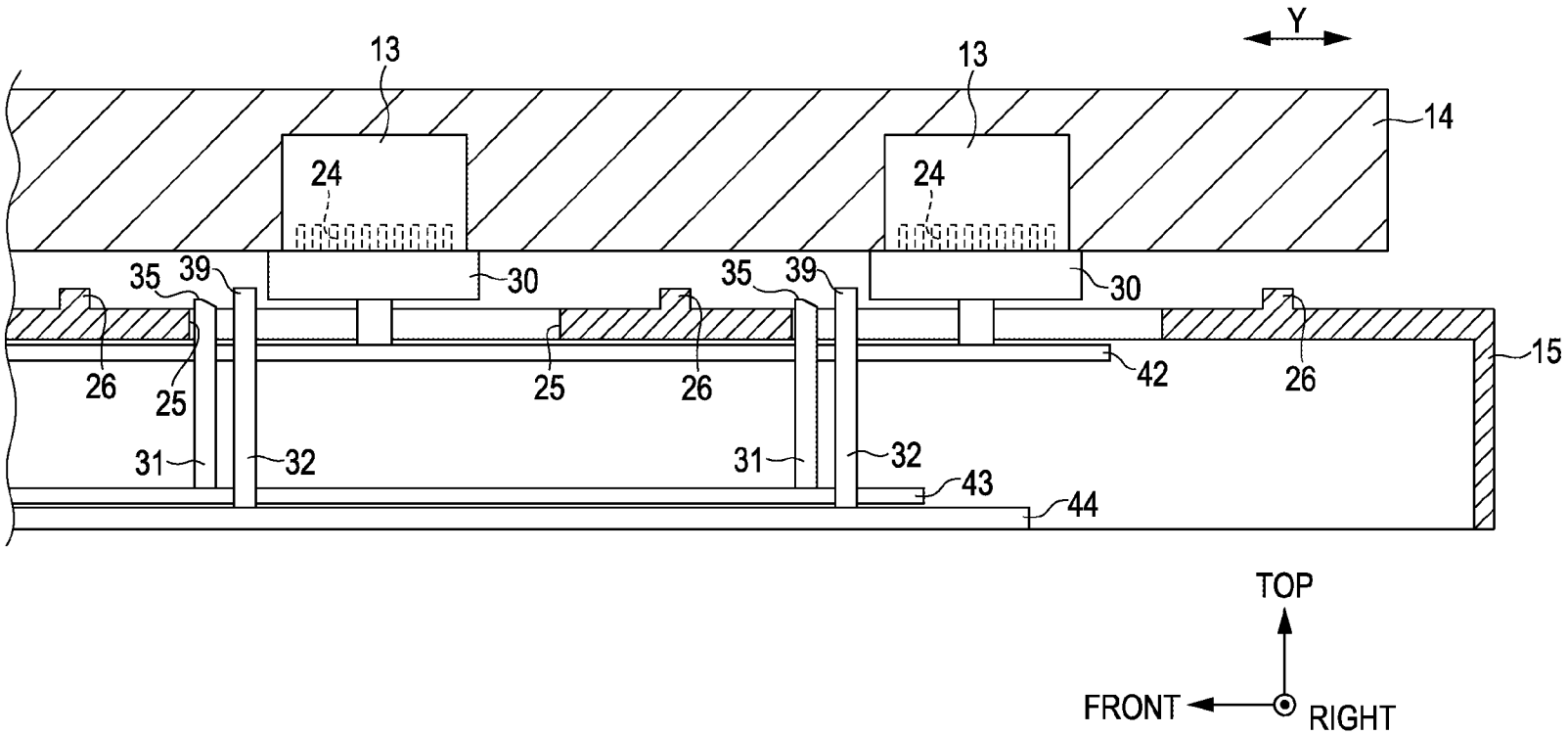
FIG. 10 is a cross-sectional view showing the position of the movable ribs when capping is performed.

When printing is completed, as shown in FIG. 10, the caps 30 are lifted by the lifting mechanism 34, and the sealing portions 30*a* are brought into contact with the nozzle forming surfaces 23 so as to enclose the nozzles 24. Thus, capping is performed. Note that the caps 30 may be configured such that the sealing portions 30*a* are in contact with the lower surface of the head unit 14 so as to enclose the nozzle forming surfaces 23, at the contact position. The wiping members 31 and the movable ribs 32 are retracted to the front side at the side of the caps 30 in the width direction Y, when the caps 30 are moved to the contact position where they are in contact with the recording heads 13.

That is, the movable ribs 32 move in the width direction Y in the opening, between the supporting position where they support the other side of the sheet P and the retracting position at a distance from the supporting position. Accordingly, the movable ribs 32 for supporting the sheet P, in addition to the caps 30 for capping, the ink absorbing members 33 for flushing, and the wiping members 31 for wiping, can be arranged at positions facing the recording heads 13. Thus, various maintenance operations can be performed on the recording heads 13, without moving the head unit 14.

According to the above-described embodiment, the following advantages can be obtained.

(1) The platen 15 has the openings 25, in which the movable ribs 32 that move in the width direction Y intersecting the transportation direction X are provided. Thus, when the sheet P is transported, the movable ribs 32 move to the supporting position to support the other side of the sheet P in cooperation with the fixed ribs 26. This prevents the leading end of the transported sheet P from dropping into an opening and being caught by the openings 25, causing a paper jam; or prevents the sheet P from dropping into an opening and bending, changing the distance between the nozzles 24 and the sheet P and deteriorating the printing quality. That is, it is possible to prevent the sheet P from dropping into the openings 25, without changing the shape of the openings 25 provided in the platen 15 that supports the other side of the sheet P, on one side of which recording is performed.

(2) Because the movable ribs 32 have a length corresponding to the openings in the transportation direction X, the movable ribs 32 can support the sheet P regardless of the shape of the openings 25.

(3) The movable ribs 32 can use the position where the fixed ribs 26 are provided in the width direction Y as the supporting position, and the region where the fixed ribs 26 are not provided in the width direction Y as the retracting position. Because the movable ribs 32 have the shape corresponding to the fixed ribs 26, by moving the movable ribs 32 to the supporting position at the side of the fixed ribs 26 in the transportation direction X, the movable ribs 32 can also support the sheet P like the fixed ribs 26.

(4) The ink absorbing members 33 for receiving ink ejected from the recording heads 13 are disposed in the openings. Because the movable ribs 32 can move in the width direction Y, when the recording heads 13 eject ink to one side of the ink absorbing members 33 in the width direction Y, the movable ribs 32 can be retracted to the other side in the width direction Y. By allowing the recording heads 13 to eject ink separately to one side and the other side of the ink absorbing members 33 in the width direction Y, the movable ribs 32 do not have to be completely retracted from the position where the ink absorbing members 33 are provided. Thus, the time required for the movable ribs 32 to be retracted from the supporting position can be reduced. Therefore, even when the sheet P is transported at high speed, flushing, in which ink is ejected toward the ink absorbing member 33, can be performed between transportation operations for transporting the sheet P.

(5) The caps 30 are disposed in the openings. Because the movable ribs 32 can move in the width direction Y, the movable ribs 32 can be retracted to the position where at the side of the caps 30 in the width direction Y, when the caps 30 are lifted and moved to the contact position where they are in contact with the recording heads 13.

(6) Because the moving mechanism 37 that moves the wiping members 31 and the movable ribs 32 in the width direction Y is provided, the movable ribs 32 and the wiping members 31 can share the moving mechanism 37. Thus, an increase in the number of components can be prevented.

(7) Because the fixed ribs 26 and the movable ribs 32 have the slanted surfaces 27 and 41, respectively, it is possible to guide the sheet P smoothly, while preventing the transported sheet P from being caught.

(8) Because the sheet P, whose rigidity is increased by the sheet-feed roller pair 20, is fed onto the platen 15, the sheet P can be securely supported by the fixed ribs 26 and the movable ribs 32 provided at positions corresponding to the corrugation rollers 20*e*, while preventing the leading end of the sheet P from dropping into the openings 25.

The above-described embodiment may be modified to other embodiments as described below.

Figure 11:
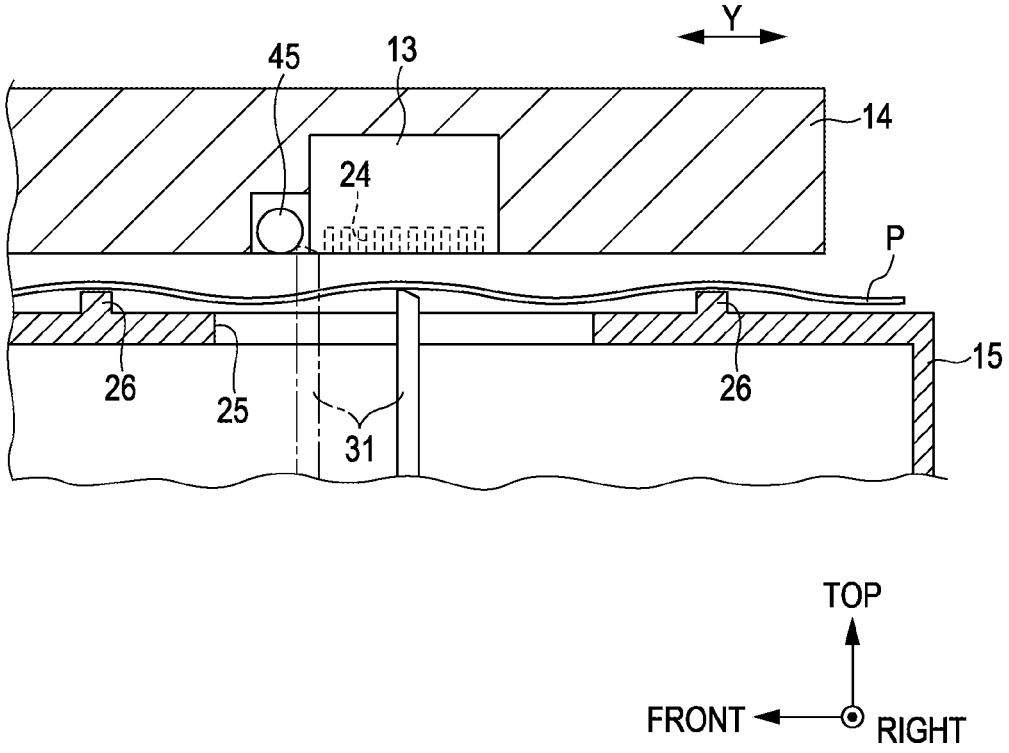
FIG. 11 is a cross-sectional view for describing a wiping member according to another embodiment, which functions as a movable rib.

As shown in FIG. 11, the other side of the sheet P may be supported by the wiping members 31, without providing the movable ribs 32. In such a case, a wiper cleaner 45 for removing ink deposited on the wiping members 31 is preferably provided to prevent ink from depositing on the other side of the sheet P. Note that, by disposing the wiper cleaner 45 at a position adjacent to the recording heads 13 of the head unit 14 in the width direction Y, the wiping members 31 can be cleaned by moving the wiping members 31 forward to a position indicated by a two-dot chain line in FIG. 11, subsequently to the wiping operation. In this configuration, because the movable supporting portion is formed of the wiping members 31 for wiping the recording heads 13, there is no need to provide a special component for forming the movable supporting portion.

The movable ribs 32 and the wiping members 31 may be retracted to the positions at the side of the caps 30 during flushing. In such a case, ink can be ejected from all the nozzles 24 in one flushing.

Flushing may be performed on the plurality of nozzles 24 arranged in rows in the front-rear direction by dividing them into three or more sections. In such a case, the movable ribs 32 may be moved sequentially to regions where ink is not ejected.

The length of the movable ribs 32 in the transportation direction X does not necessarily have to cover the entire length of the openings 25, and the length may be adjusted according to, for example, the size of the caps 30, etc.

The sheet-feed roller pair 20 does not necessarily have to have the corrugation rollers 20*e*.

The movable supporting portion does not necessarily have to have a shape corresponding to the fixed ribs 26, and it may have, for example, a shutter-like shape that can close the openings 25.

The purpose of providing the openings 25 may be not to provide the caps 30 and the ink absorbing member 33, but, for example, to reduce the weight of the platen 15. In such a case, a configuration in which the wiping members 31, the caps 30, and the ink absorbing members 33 are not provided is possible.

It is possible to use the caps 30 as the receptacles, without employing the ink absorbing members 33.

It is possible to provide only the ink absorbing members 33, without the caps 30. In such a case, the lifting mechanism 34 is unnecessary.

The wiping members 31 and the movable ribs 32 may be moved in the width direction Y by different moving mechanisms.

The recording heads 13 do not necessarily have to eject ink downward, but may eject ink in a direction intersecting the top-bottom direction (gravitational direction).

Although the recording apparatus is embodied as an ink jet printer in the above-described embodiments, it may be embodied as a fluid ejecting apparatus for ejecting or discharging fluid other than ink, and it may be used as various liquid ejecting apparatuses having a liquid eject head or the like for ejecting a small amount of droplets. The term "droplets" refers to a state of liquid ejected from the above-described liquid ejecting apparatus and includes particle-like droplets, teardrop-like droplets, and string-like droplets having tails. Furthermore, the liquid as used herein is a material that can be ejected from liquid ejecting apparatuses. For example, liquid-phase substances may be used. Such materials include liquid having high or low viscosity, liquid, such as sol, gel water, inorganic solvent other than these, organic solvent, solution, liquid resin, and liquid metal (metal melt). In addition to liquid as one state of substance, materials in which particles of functional materials made of solids, such as pigments and metal particles, are dissolved, dispersed or mixed in solvents are included. Representative examples of the liquid include ink described in the above embodiment and liquid crystal. Herein, ink includes various liquid compositions, such as typical aqueous ink, oil-based ink, gel ink, and hot melt ink. Specific examples of the liquid ejecting apparatus include liquid ejecting apparatuses used for manufacturing, for example, liquid crystal displays, EL (electroluminescence) displays, surface light emitting displays and color filters, the liquid ejecting apparatuses ejecting liquid containing electrode material or colorant dispersed or dissolved therein; liquid ejecting apparatuses used for manufacturing biochips, the liquid ejecting apparatuses ejecting living organic materials; liquid ejecting apparatuses used as precise pipettes that eject liquid serving as a specimen; textile printing apparatuses; and microdispensers. In addition, the invention can be applied to liquid ejecting apparatuses that eject grease to precision machines, such as watches and cameras, in a pinpoint manner; liquid ejecting apparatuses that eject transparent liquid resin, such as ultraviolet curable resin, to form fine hemispherical lenses (optical lenses) used for optical communication elements; and liquid ejecting apparatuses that eject acid or alkaline etching liquid for etching substrates. The invention can be applied to one of the above-described ejecting apparatuses.

The invention can be applied not only to an ink jet printer (fluid ejecting apparatus) that ejects fluid, but also to printers, facsimiles, and copiers of any type, such as a dot-impact type, having a supporting member (platen), and to multi-function apparatuses having these functions.

What is claimed is:

1. A recording apparatus for performing recording on a medium being transported, the recording apparatus comprising:

a recording head that performs recording on one side of a medium being transported in a transportation direction;

a supporting member having a fixed supporting portion that is fixed and supports the other side of the medium, and an opening provided in a region facing the recording head; and a movable supporting portion that moves in the opening in a width direction intersecting the transportation direction between a supporting position where it supports the other side of the medium and a position at a distance from the supporting position.

2. The recording apparatus according to claim 1, wherein the movable supporting portion has a length corresponding to the opening in the transportation direction.

3. The recording apparatus according to claim 1, wherein the fixed supporting portion includes a plurality of fixed ribs that are arranged side-by-side in the width direction and extend in the transportation direction, and wherein the movable supporting portion includes a movable rib having a shape corresponding to the fixed ribs.

4. The recording apparatus according to claim 1, wherein the recording head performs recording by ejecting fluid onto the medium, wherein a receptacle for receiving the fluid ejected from the recording head is disposed in the opening, and wherein, when the recording head ejects fluid onto one side of the receptacle in the width direction, the movable supporting portion is retracted to the other side in the width direction.

5. The recording apparatus according to claim 1, further comprising a cap that can move between a contact position where it is in contact with the recording head through the opening and a separated position at a distance from the recording head, wherein the movable supporting portion is retracted to a position at the side of the cap in the width direction when the cap moves to the contact position.

6. The recording apparatus according to claim 1, further comprising a wiping member that moves in the width direction to wipe the recording head, wherein the movable supporting portion is formed of the wiping member.

7. The recording apparatus according to claim 1, further comprising:

a wiping member that moves in the width direction to wipe the recording head; and a moving mechanism that moves the wiping member and the movable supporting portion in the width direction.

8. The recording apparatus according to claim 1, wherein the recording head includes a plurality of recording heads corresponding to different colors of ink, each having a nozzle forming surface having nozzles through which ink is ejected, and wherein the plurality of recording heads are arranged in the transportation direction for each color.

9. The recording apparatus according to claim 8, wherein the recording heads for ejecting ink of the same color are arranged in a staggered manner in the width direction.

10. The recording apparatus according to claim 8, wherein the opening is provided in a region facing the nozzle forming surface of the recording head.

* * * * *